US012630962B2

(12) United States Patent
Xu et al.

(10) Patent No.: US 12,630,962 B2
(45) Date of Patent: May 19, 2026

(54) CONTROL METHOD FOR WASHING MACHINE AND WASHING MACHINE

(71) Applicants: Qingdao Haier Laundry Electric Appliances Co., Ltd., Shandong (CN); Haier Smart Home Co., Ltd., Shandong (CN)

(72) Inventors: Sheng Xu, Shandong (CN); Yanfen Lv, Shandong (CN)

(73) Assignees: QINGDAO HAIER LAUNDRY ELECTRIC APPLIANCES CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 77 days.

(21) Appl. No.: 18/706,725

(22) PCT Filed: Oct. 11, 2022

(86) PCT No.: PCT/CN2022/124557
§ 371 (c)(1),
(2) Date: May 1, 2024

(87) PCT Pub. No.: WO2023/078037
PCT Pub. Date: May 11, 2023

(65) Prior Publication Data

US 2025/0059697 A1 Feb. 20, 2025

(30) Foreign Application Priority Data

Nov. 2, 2021 (CN) ..... 202111287493.8

(51) Int. Cl.
*D06F 39/08* (2006.01)
*D06F 39/10* (2006.01)
*D06F 105/08* (2020.01)

(52) U.S. Cl.
CPC ..... *D06F 39/085* (2013.01); *D06F 39/087* (2013.01); *D06F 39/10* (2013.01); *D06F 2105/08* (2020.02)

(58) Field of Classification Search
CPC ..... D06F 39/085
See application file for complete search history.

(56) References Cited

U.S. PATENT DOCUMENTS

2021/0198829 A1 7/2021 Kang et al.

FOREIGN PATENT DOCUMENTS

CN 103361938 A 10/2013
CN 103835095 A 6/2014
(Continued)

OTHER PUBLICATIONS

International Search Report and Written Opinion issued Feb. 10, 2023 in PCT/CN2022/124557 (translation of ISR only).
(Continued)

*Primary Examiner* — Jason Y Ko
(74) *Attorney, Agent, or Firm* — Panitch Schwarze Belisario & Nadel LLP

(57) ABSTRACT

A washing machine including a water container and a circulating filtration pipeline with a water inlet end and a water outlet end being connected to the water container. A pump assembly and a filtering device installed on the circulating filtration pipeline and having a water inlet, a filtered water outlet and a sewage outlet. A sewage pipeline receives sewage discharged from the sewage outlet. A control valve assembly that controls the washing machine to alternately execute a circulating filtration operation to perform a circulating filtration of water in the water container and a sewage discharge operation where the sewage in the filtering device is discharged into the sewage pipeline.

18 Claims, 6 Drawing Sheets

(56) References Cited

FOREIGN PATENT DOCUMENTS

| | | | |
|---|---|---|---|
| CN | 104975475 | A | 10/2015 |
| CN | 105088697 | A | 11/2015 |
| CN | 110952265 | A | 4/2020 |
| CN | 111714059 | A | 9/2020 |
| CN | 111719288 | A | 9/2020 |
| EP | 3081687 | A1 | 10/2016 |
| JP | H0395895 | U | 9/1991 |
| JP | H081753 | Y2 | 1/1996 |
| JP | 2002066198 | A | 3/2002 |
| WO | 2014206313 | A1 | 12/2014 |
| WO | 2020187638 | A1 | 9/2020 |
| WO | 2021116933 | A1 | 6/2021 |

OTHER PUBLICATIONS

English Translation of Office Action issued on Jul. 29, 2025, by the Japanese Patent Office in corresponding JP Application No. 2024-533839 (7 pages).

Extended European Search Report issued on Dec. 11, 2024, by the European Patent Office in EP Application No. 22889063.8.

CONTROL METHOD FOR WASHING MACHINE AND WASHING MACHINE

CROSS-REFERENCE TO RELATED APPLICATIONS

This application is a Section 371 of International Application No PCT/CN2022/124557, filed Oct. 11, 2022, which was published in the Chinese language on May 11, 2023, under International Publication No. WO 2023/078037 A1, which claims priority under 35 U.S.C. § 119(b) to Chinese Application No. 202111287493.8, filed Nov. 2, 2021, the disclosures of each of which are incorporated herein by reference.

TECHNICAL FIELD

The disclosure belongs to the technical field of washing machines, and specifically relates to a control method for a washing machine and a washing machine.

BACKGROUND

During the washing process of the clothes in the washing machine, due to the friction between the clothes and the clothes and the washing machine itself, lint will fall off the clothes and mix into the washing water. If the lint in the washing water cannot be removed, it is likely to adhere to the surface of the clothes after the washing is completed, affecting the cleaning effect of the clothes. For this reason, existing washing machines are equipped with a filter for filtering lint. During the washing process, the washing water is continuously passed through the filter to remove lint from the washing water.

The filter of the existing washing machine is generally installed inside the inner barrel or the drainage pump, and is used to filter lint and debris in the washing water. However, after the washing machine is used for a long time, the filter will be filled with lint and debris, which will affect the filtration effect of the filter, cause the drain valve/drain pump to become blocked, and it is easy to breed bacteria. It needs to be cleaned in time, otherwise it will cause pollution of the washing water, and cause secondary pollution to the clothes, and affect the health of users. However, most washing machines require users to remove the filter and clean it manually, which is inconvenient to operate.

For this reason, the prior art has proposed a filtering device with a self-cleaning function, which can automatically clean filtered impurities such as lint shavings attached inside after completing the filtration process, and discharge the cleaned filtered impurities through the water flow. However, most washing machines clean the filtering device and discharge the sewage only after the washing or rinsing phase is completed, or even after the washing machine runs a complete washing cycle. When the amount of lint in the water is large, the filtered impurities may cover the filtering device. The filter screen affects the filtration efficiency of filtering impurities. In severe cases, it may also cause filtered impurities to become clogged, causing the cyclic filtration to be unable to continue, affecting the user experience.

In view of this, the present disclosure is proposed.

SUMMARY

The technical problem to be solved by the present disclosure is to overcome the deficiencies of the prior art and provide a control method for the washing machine and a washing machine. The washing machine alternately performs a circulation filtration operation and a sewage discharge operation during the washing/rinsing process, and can perform the circulation filtration operation in the process. The filtered impurities remaining inside the filtering device are discharged in time to avoid the accumulation of filtered impurities inside the filtering device and affecting the filtration efficiency.

In order to solve the above technical problems, the basic concept of the technical solution adopted by the present disclosure is:

A control method for a washing machine, the washing machine comprising:

a water container;

a circulating filtration pipeline, with a water inlet end and a water outlet end of the circulating filtration pipeline being connected to the water container respectively, and a pump assembly being installed thereon;

a filtering device, being configured to install on the circulating filtration pipeline and to have a water inlet, a filtered water outlet and a sewage outlet;

a sewage pipeline, being configured to receive sewage discharged from the sewage outlet; and a control valve assembly; wherein, during a washing or a rinsing process, the washing machine alternately executes:

a circulating filtration operation, in which the pump assembly is in an open state, the control valve assembly connects the pump assembly and the water inlet and disconnects the sewage outlet and the sewage pipeline to perform a circulating filtration of water in the water container; and a sewage discharge operation, in which the pump assembly is in a closed state, the control valve assembly disconnects the pump assembly and the water inlet and connects the sewage outlet and the sewage pipeline, and the sewage in the filtering device is discharged into the sewage pipeline.

Further, during the circulating filtration operation, the pump assembly is controlled to be turned on intermittently;

preferably, the circulating filtration operation includes the following steps:

S1. the control valve assembly connecting the pump assembly and the water inlet and disconnecting the sewage outlet and the sewage pipeline;

S2. turning on the pump assembly and continue for a certain period of time;

S3. turning off the pump assembly and continue for a certain period of time;

S4. if step S2 is performed a number of times in the circulating filtration operation reaches a preset number of times, end the circulating filtration operation; otherwise, returning to step S2.

Further, during the circulating filtration operation, the pump assembly continues to operate for a first preset time period $T_1$ after being turned on for a first time, and the pump assembly continues to operate for a second preset time length $T_2$ after each subsequent turn on; the first preset time length $T_1$ is greater than the second preset time length $T_2$.

Further, the Filtering Device Includes:

a filtering cavity, being configured to arrange a water inlet, filtered water outlet and sewage outlet;

a filtering mechanism, being rotatably installed in the filtering cavity;

a driving mechanism, being configured to drive the filtering mechanism to rotate in the filtering cavity;

Step S3 further includes: while the pump assembly is closed, turning on the driving mechanism to drive the filtering mechanism to rotate in the filtering cavity.

Further, in step S3, the filtering mechanism continues to rotate while the pump assembly is turned off, and each time the drive mechanism is turned on, the filtering mechanism continues to rotate for a same length of time;

preferably, in step S2, the pump assembly continues to operate at least the second preset time length $T_2$ after being turned on, in step S3, the filtering mechanism continues to operate a third preset time length $T_3$, and the third preset time length $T_3$ is less than the second preset time length $T_2$.

Further, the washing machine further includes a discharge pipeline for draining water to outside, and the control valve assembly connects the sewage outlet and the sewage pipeline while connecting the pump assembly and the discharge pipeline;

after the washing or the rinsing process is completed, the control valve assembly connects the pump assembly and the discharge pipeline, turns on the pump assembly, and the water in the water container is discharged from the washing machine through the discharge pipeline.

Further, before water supply for the washing or the rinsing process, the control valve assembly connects the pump assembly and the water inlet and disconnects the sewage outlet and the sewage pipeline;

starting to supply water into the water container, after a water level in the water container is greater than a preset water level, turning on the pump assembly to perform the circulating filtration operation, after the circulating filtration operation is completed, performing the sewage discharge operation;

the circulating filtration operation and the sewage discharge operation are executed alternately until the washing or the rinsing process is completed.

Another object of the present disclosure is to provide a washing machine that adopts the above-mentioned control method for the washing machine.

Further, the Control Valve Assembly Comprising:

a valve body, being configured to arrange a first valve chamber and a second valve chamber that are independent of each other in the valve body, wherein, the first valve chamber is provided with a water inlet connected to the pump assembly and a circulating water outlet connected to the water inlet; the second valve chamber is provided with a sewage inlet communicated with the sewage outlet and a sewage outlet communicated with the sewage pipeline;

a switching mechanism, being movably arranged inside the valve body and being configured to have a first position for opening the circulating water outlet and blocking the sewage inlet, and a second position for blocking the circulating water outlet and opening the sewage inlet;

preferably, the washing machine further includes a discharge pipeline for draining water to the outside, and the first valve chamber is further provided with a drainage outlet connected to the discharge pipeline;

when the switching mechanism is in the first position, the drainage outlet is blocked, and when the switching mechanism is in the second position, the drainage outlet is opened.

Further, the Filtering Device Comprising:

a filtering cavity, being configured to arrange with the water inlet, the filtered water outlet and the sewage outlet;

a filtering mechanism, being rotatably installed in the filtering cavity;

cleaning particles, being arranged in the filtering cavity and being configured to clean an inner wall of the filtering cavity and an outer wall of the filtering mechanism with friction and collision of water flow.

After adopting the above technical solution, the present disclosure has the following beneficial effects compared with the prior art.

In the present disclosure, the washing machine alternately performs the circulating filtration operation and the sewage discharge operation during the washing/rinsing process, so that the filtered impurities remaining inside the filtering device during the circulating filtration operation can be discharged in time, and the accumulation of filtered impurities inside the filtering device can be avoided. Compared with the method of continuously performing circulating filtration operation until the end of washing/rinsing, it prevents excessive accumulation of filtered impurities from causing clogging of the filtration device.

In the present disclosure, the pump assembly is intermittently turned on during the circulating filtration operation of the washing machine. The closing of the pump assembly provides an opportunity for the filtered impurities attached to the interior of the filtering device to fall off, preventing the filtered impurities from being too firmly attached to the interior of the filtering device. The situation where the sewage cannot be discharged sufficiently when performing the sewage discharge operation. During the shutdown of the pump assembly, the driving mechanism drives the filtering mechanism to rotate, which can stir the water in the filtering cavity, thereby generating agitated water flow. The filtered impurities attached to the outer wall of the filtering mechanism can be peeled off under the dual effects of the centrifugal force generated by the rotation and the agitated water flow. It is helpful to improve the cleaning efficiency of filtering impurities.

In the present disclosure, the control valve assembly, as an integral structure, can simultaneously control the on-off of multiple independent waterways through changes in the position of the switching mechanism, and then control the washing machine to perform circulating filtration operation, sewage discharge operation and drainage operations respectively through the on-off conditions of the waterways, which simplifies the control structure and control logic of the water path inside the washing machine, which is beneficial to reducing production costs.

In the present disclosure, cleaning particles are arranged in the filtering cavity. During the filtration process, the cleaning particles are driven by the water flow and continuously rub against the inner wall of the filtering cavity and the outer wall of the filtering mechanism, which can further prevent the deposition of filtered impurities, thereby avoiding clogging of the filtering device and affecting the filtration efficiency. When the filtering mechanism is controlled to rotate in the filtering cavity, the cleaning particles move with the water flow, which is conducive to further strengthening the agitation of the water flow, thereby making it easier for attached filtered impurities to fall off, and improving the self-cleaning efficiency of the filtering device.

Specific embodiments of the present disclosure will be described in further detail below with reference to the accompanying drawings.

BRIEF DESCRIPTION OF THE DRAWINGS

The drawings, as part of the present disclosure, are used to provide a further understanding of the present disclosure.

The schematic embodiments of the present disclosure and their descriptions are used to explain the present disclosure, but do not constitute an improper limitation of the present disclosure. Obviously, the drawings in the following description are only some embodiments. For those of ordinary skill in the art, other drawings can be obtained based on these drawings without exerting creative efforts. In the attached drawings.

Figure 1:
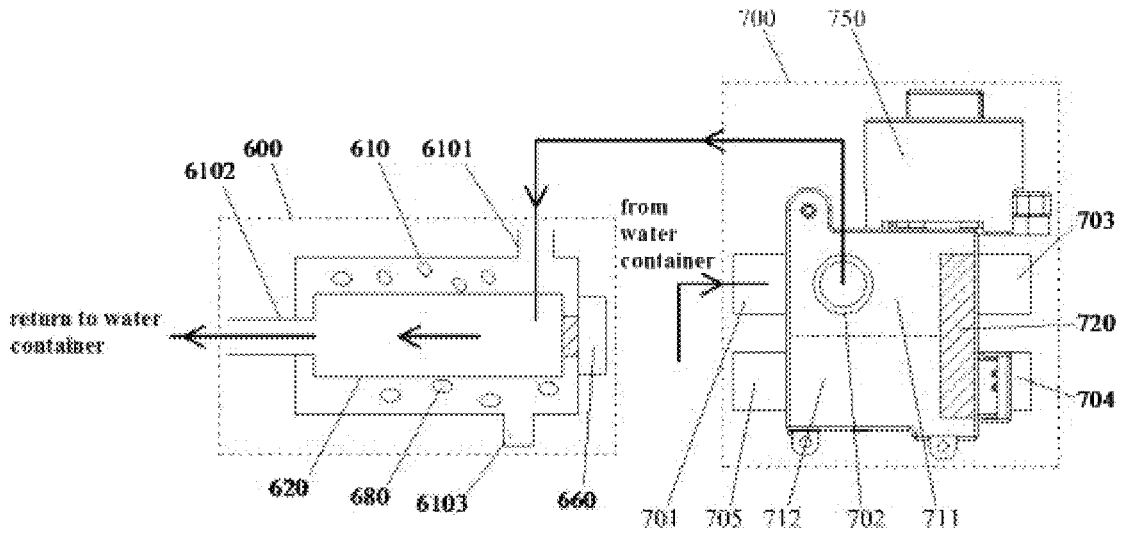
FIG. 1 is a schematic diagram of the waterway communication structure of the control valve assembly in the embodiment of the present disclosure when the switching mechanism is in the first position.
Figure 2:
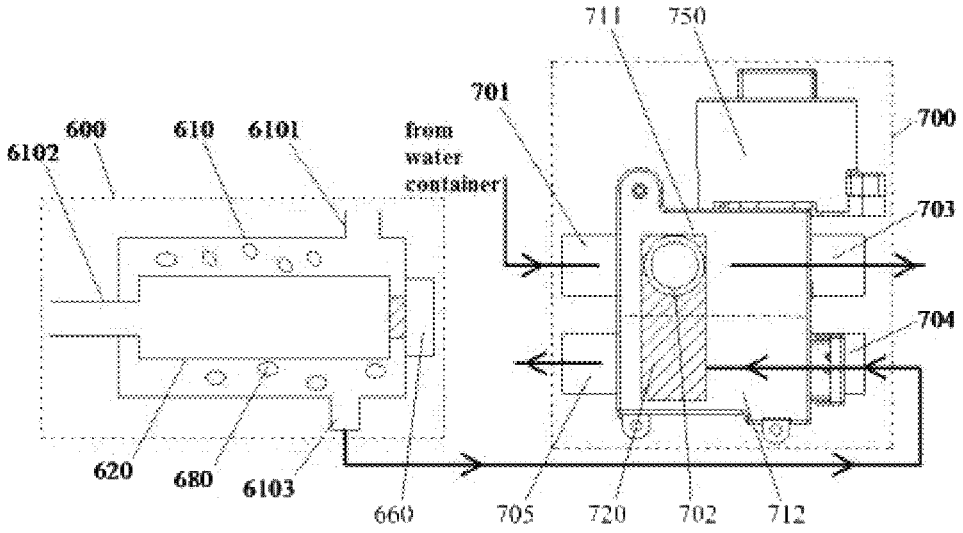
FIG. 2 is a schematic diagram of the waterway communication structure of the control valve assembly in the embodiment of the present disclosure when the switching mechanism is in the second position.

In the picture: 10. box body; 100. water container; 110. window gasket; 210. drainage pipeline; 220. circulation pipeline; 230. return water pipeline; 231. return water control valve; 240. sewage pipeline; 250. discharge pipeline; 260. water container drainage pipe; 280. connecting pipeline; 300. detergent box; 400. pump assembly; 500. recovery device; 501. filtered impurities; 510. housing; 520, filter component; 531. first chamber; 532. second chamber;

600. filtering device; 601. first limiting surface; 602. second limiting surface; 603. third limiting surface; 604. fourth limiting surface; 605. fifth limiting surface; 606. sixth limiting surface surface; 610. filtering cavity; 6101. water inlet; 6102. filtered water outlet; 6103. sewage outlet; 6104. installation opening; 611. sealing support part; 612. sleeve part; 613. reinforcing rib; 620. filtering mechanism; 621. water outlet joint; 622. rotating support part; 623. filter support part; 624. motor mounting part; 625. filter screen; 631. first bearing; 632. second bearing; 641. first seal; 642. second seal; 643. third seal; 650. filtering cavity flange; 651. connection part; 652. insertion part; 653. through port; 660. driving mechanism; 680. cleaning particles;

700. control valve assembly; 701. water inlet; 702. circulating water outlet; 703. drainage outlet; 704. sewage inlet; 705. sewage outlet; 710. valve body; 711. first valve chamber; 712. second valve chamber; 720. switching mechanism; 732. circulation sealing component; 733. drainage sealing component; 740. flip; 741. first surface; 742. second surface; 750. driving motor.

It should be noted that these drawings and text descriptions are not intended to limit the scope of the disclosure in any way, but are intended to illustrate the concept of the disclosure for those skilled in the art by referring to specific embodiments.

DETAILED DESCRIPTION

In order to make the purpose, technical solutions and advantages of the embodiments of the present disclosure clearer, the technical solutions in the embodiments of the present disclosure will be clearly and completely described below in conjunction with the drawings in the embodiments of the present disclosure. The following examples are used to illustrate the present disclosure, but are not used to limit the scope of the present disclosure.

In the description of the present disclosure, it should be noted that the terms "upper", "lower", "front", "back", "left", "right", "vertical", "inner", "outer", etc. The indicated orientation or positional relationship is based on the orientation or positional relationship shown in the drawings.

It is only for the convenience of describing the present disclosure and simplifying the description. It does not indicate or imply that the device or element referred to must have a specific orientation or a specific orientation. construction and operation, and therefore should not be construed as limitations of the disclosure.

In the description of the present disclosure, it should be noted that, unless otherwise clearly stated and limited, the terms "installation", "connection" and "connection" should be understood in a broad sense. For example, it can be a fixed connection or a detachable connection. Connection, or integral connection; it can be a mechanical connection or an electrical connection; it can be a direct connection or an indirect connection through an intermediate medium. For those of ordinary skill in the art, the specific meanings of the above terms in the present disclosure can be understood on a case-by-case basis.

Embodiment 1

As Shown in FIGS. 1 to 5, the Washing Machine in this Embodiment Includes:

- a water container 100;
- a circulating filter pipeline, a water inlet end and a water outlet end of which are respectively connected with the water container 100, and a pump assembly 400 is provided on it;
- a filtering device 600 is provided on the circulating filter pipeline and has a water inlet 6101, a filtered water outlet 6102 and a sewage outlet 6103;
- a sewage pipeline 240 for receiving the sewage discharged from the sewage outlet 6103; and, a control valve assembly 700.

Specifically, Control Valve Assembly 700 Includes:

- a valve body 710, which has a first valve chamber 711 and a second valve chamber 712 that are independent of each other. The first valve chamber 711 is provided with a water inlet 701 connected to the pump assembly 400, and a circulating water outlet 702 connected to the water inlet 6101. The second valve chamber 712 is provided with a sewage inlet 704 connected to the sewage outlet 6103, and a sewage outlet 705 connected to the sewage pipeline 240;
- a switching mechanism 720, which is movably arranged inside the valve body 710 and has a first position for opening the circulating water outlet 702 and blocking the sewage inlet 704, and a second position for blocking the circulating water outlet 702 and opening the sewage inlet 704.

In this embodiment, the water inlet 701 of the first valve chamber 711 and the sewage outlet 705 of the second valve chamber 712 are open by default. When the switching mechanism 720 is in the first position, the water inlet 701 and the circulating water outlet 702 are both open, and the pump assembly 400 is connected to the water inlet 6101 of the filtering device 600; at the same time, the sewage inlet 704 is blocked, and the filtering device 600 is disconnected from the sewage outlet 6103 and the sewage pipeline 240.

When the switching mechanism 720 is in the second position, the circulating water outlet 702 is in a blocked state, and the pump assembly 400 is disconnected from the water inlet 6101 of the filtering device 600; at the same time, the sewage inlet 704 and the sewage outlet 705 are both open, and the sewage outlet 6103 of the filtering device 600 is connected to the sewage pipeline 240.

The control valve assembly 700 of this embodiment has two working states, corresponding to the switching mechanism 720 being in different positions. Specifically, the first working state of the control valve assembly 700 is that the switching mechanism 720 is in the first position, connecting the pump assembly 400 and the water inlet 6101 and disconnecting the sewage outlet 6103 and the sewage pipeline 240; the second working state of the control valve assembly 700 is that the switching mechanism 720 is in the second position, disconnecting the pump assembly 400 and the water inlet 6101 and connecting the sewage outlet 6103 and the sewage pipeline 240.

In the above solution, the control valve assembly 700 can simultaneously control the connection between the pump assembly 400 and the water inlet 6101 of the filtering device 600, and the connection between the sewage outlet 6103 of the filtering device 600 and the sewage pipeline 240. By switching the working state of the control valve assembly 700, the filtering device 600 can be switched between the two working processes of filtration and sewage discharge. The control valve assembly 700 can simultaneously control the opening and closing of two relatively independent water channels, which is beneficial to simplifying the layout of the internal water channel structure of the washing machine and making the control logic of the water channel opening and closing simpler.

In this embodiment, the washing machine alternately performs the circulation filtering operation and the sewage discharge operation during the washing/rinsing process.

Wherein, the circulation filtering operation includes: the pump assembly 400 is in an open state, the control valve assembly 700 is in the first working state, that is, the control valve assembly 700 connects the pump assembly 400 and the water inlet 6101 and disconnects the sewage outlet 6103 and the sewage pipeline 240, the water in the water container 100 is circulated and filtered.

The sewage discharge operation includes: the pump assembly 400 is in a closed state, the control valve assembly 700 is in the second working state, that is, the control valve assembly 700 disconnects the pump assembly 400 and the water inlet 6101 and connects the sewage outlet 6103 and the sewage pipeline 240, and the sewage in the filtering device 600 is discharged into the sewage pipeline 240.

In the above scheme, by alternately performing the circulation filtering operation and the sewage discharge operation during the washing/rinsing stage of the washing machine, the filtered impurities such as lint residues remaining inside the filtering device 600 during the circulation filtering process can be discharged in a timely manner, thereby preventing the filtered impurities from being internal accumulation in the filtering device 600, affecting the filtration efficiency. Especially when the content of filtered impurities such as lint in the water is high, the solution of this embodiment, compared with the method of continuously performing the circulation filtering operation until the end of washing/rinsing, effectively prevents excessive accumulation of filtered impurities, causing the filtering device 600 to become clogged.

In this embodiment, the pump assembly 400 may be a water pump that generates suction force to draw out the water in the water container 100 for circulation filtration.

In a further solution of this embodiment, while the washing machine is performing a circulation filtering operation, the pump assembly 400 is controlled to be turned on intermittently. Through the intermittent opening of the pump assembly 400, during the period when the pump assembly 400 is closed, the water in the water container 100 pauses passing through the filtering device 600, and the filtered impurities attached to the inside of the filtering device 600 can fall off and merge into the water during this period, and then perform the sewage discharge operation. It is discharged with the water flow. This avoids the situation where the water flow is filtered through the filtering device 600 for too long, causing the filtered impurities to adhere too firmly inside the filtering device 600 and cannot be fully discharged during the sewage discharge operation.

It can be understood that increasing the frequency of alternate execution of circulation filtration operations and sewage discharge operations can also achieve the purpose of preventing filtered impurities from being too firmly attached. However, alternate execution of the circulation filtering operation and the sewage blowdown operation requires the control valve assembly 700 to switch working states. For the control valve assembly 700, too frequent switching of working states may result in shortened service life.

In this embodiment, by controlling the pump assembly 400 to be turned on intermittently during the circulation filtering operation, the pump assembly 400 can be prevented from continuing to work for a long time, the service life of the pump assembly 400 can be extended, and the control valve assembly 700 can be avoided from frequently switching. In the working state, the control valve assembly 700 is protected.

In the Specific Solution of this Embodiment, the Circulation Filtering Operation Includes the Following Steps:

S1. The control valve assembly 700 being controlled to connects the pump assembly 400 and the water inlet 6101 and disconnects the sewage outlet 6103 and the sewage pipeline 240;

S2. Turn on the pump assembly 400 and continue for a certain period of time;

S3. Turn off the pump assembly 400 for a certain period of time; S4. If the number of times step S2 is performed in this circulation filtering operation reaches the preset number, end the circulation filtering operation; otherwise, return to step S2.

Further, during the execution of a circulation filtering operation, the pump assembly 400 continues to run for the first preset time period $T_1$ after being turned on for the first time, and then continues to run for the second preset time period $T_2$ after being turned on each time. The first preset time length $T_1$ is greater than the second preset time length $T_2$.

In the above solution, a filter screen is provided inside the filtering device 600, and the filtering process is implemented through the mesh on the filter screen. The specific values of the first preset time length $T_1$ and the second preset time length $T_2$ can be obtained in advance through a large number of experiments and directly written into the control program of the washing machine. The first preset time length $T_1$ is specifically that the length of time it takes for most of the mesh holes on the filter to be covered by filtered impurities during continuous filtration of the filtering device 600.

In a circulation filtering operation, when the pump assembly 400 is turned on for the first time, there are basically no filtered impurities attached to the filter screen, so the value of the first preset time period $T_1$ can be larger. During the shutdown of the pump assembly 400, there is no guarantee that the filtered impurities attached to the filter screen will completely fall off. That is, every time the pump assembly 400 is turned on thereafter, some filtered impurities may be attached to the filter screen. Therefore, the value of the second preset time period $T_2$ is less than the first preset time period $T_1$ to avoid clogging of the filter screen and affecting the filtration process.

In this Embodiment, the Filtering Device 600 Includes:

- a filtering cavity 610, which is provided with a water inlet 6101, a filtered water outlet 6102 and a sewage outlet 6103;
- a filtering mechanism 620, which is rotatably arranged in the filtering cavity 610;
- a driving mechanism 660, which is used to drive the filtering mechanism 620 to rotate in the filtering cavity 610.

Step S3 also includes: while the pump assembly 400 is closed, the driving mechanism 660 is turned on to drive the filtering mechanism 620 to rotate in the filtering cavity 610.

Specifically, the filtering mechanism 620 divides the interior of the filtering cavity 610 into an outer cavity and an inner cavity, wherein the water inlet 6101 is connected to the outer cavity, and the filtered water outlet 6102 is connected to the inner cavity. The water in the water container 100 enters the outer cavity through the water inlet 6101 under the action of the pump assembly 400, and enters the inner cavity through the filtering mechanism 620 to be filtered. The lint carried in the water adheres to the outer wall of the filtering mechanism 620.

In this embodiment, the driving mechanism 660 is turned on when the pump assembly 400 is closed. The driving mechanism 660 drives the filtering mechanism 620 to rotate, which can stir the water flow in the filtering cavity 610, so that the filtered impurities attached to the outer wall of the filtering mechanism 620 are peeled off under the action of the combination of centrifugal force and agitation of the water flow, and blends into the water in the filtering cavity 610, which helps the filtered impurities attached to the outer wall of the filtering mechanism 620 to fully fall off.

In this embodiment, cleaning particles 680 are further provided in the filtering cavity 610. The cleaning particles 680 are used to clean the inner wall of the filtering cavity 610 and the outer wall of the filtering mechanism 620 by friction and collision with the water flow. During the opening of the pump assembly 400, the water flow continues to pass through the filtering device 600, and the cleaning particles 680 are driven by the water flow to continuously rub against the inner wall of the filtering cavity 610 and the outer wall of the filtering mechanism 620, which can slow down the deposition of filtered impurities, thereby appropriately extending duration of continuous activation of the pump assembly 400. When the driving mechanism 660 drives the filtering mechanism 620 to rotate, the cleaning particles 680 move with the water flow, which is conducive to further strengthening the agitation of the water flow, thereby making it easier for the attached filtered impurities to fall off.

Furthermore, in step S3 of this embodiment, the filtering mechanism 620 continues to rotate while the pump assembly 400 is closed, and each time the driving mechanism 660 is turned on, the filtering mechanism 620 continues to rotate for the same length of time.

Preferably, the continuous rotation time of the filtering mechanism 620 in step S3 is the third preset time length $T_3$, and the third preset time length $T_3$ is less than the second preset time length $T_2$.

- the third preset time period $T_3$ can be obtained in advance through a large number of experiments and directly written into the control program of the washing machine to ensure that filtered impurities such as lint and other lint attached to the filtering mechanism 620 can be fully shed.

In a further solution of this embodiment, the washing machine further includes a discharge pipeline 250 for draining water to the outside. The control valve assembly 700 not only connects the sewage outlet 6103 and the sewage pipeline 240, but also connects the pump assembly 400 with the discharge pipeline 250.

Specifically, the first valve chamber 711 of the control valve assembly 700 is provided with a drainage outlet 703 that communicates with the discharge pipeline 250. In the first working state of the control valve assembly 700, that is, when the switching mechanism 720 is in the first position, the switching mechanism 720 blocks the drainage outlet 703. In the second working state of the control valve assembly 700, the switching mechanism 720 is in the second position and the drainage outlet 703 is opened.

After the washing/rinsing process is completed, the control valve assembly 700 connects the pump assembly 400 and the discharge pipeline 250, opens the pump assembly 400, and the water in the water container 100 is discharged from the washing machine through the discharge pipeline 250.

In Detail, the Circulating Filter Pipeline of the Washing Machine in this Embodiment Specifically Includes:

- a water container drain pipe 260, which connects the water container 100 and the water inlet end of the pump assembly 400;
- a drainage pipeline 210, one end of which is connected to the water outlet end of the pump assembly 400 and the other end is connected to the water inlet 701 of the control valve assembly 700;
- a circulation pipeline 220, one end of which is connected to the circulating water outlet 702 of the control valve assembly 700 and the other end connected to the water inlet 6101 of the filtering device 600;
- a return water pipeline 230, one end of which is connected to the filtered water outlet 6102 of the filtering device 600, and the other end is connected to the water container 100 to transport the filtered water to the water container 100;
- a discharge pipeline 250, one end of which is connected to the drainage outlet 703 of the control valve assembly 700, and the other end leads to the outside of the washing machine.

In the above solution, the pump assembly 400 is used for both circulating filtration of water in the water container 100 and for draining water from the washing machine. Moreover, the circulating filtration and drainage share part of the pipeline structure, which simplifies the layout of the waterway structure inside the washing machine and is beneficial to save space inside the washing machine.

After the washing/rinsing is completed, the control valve assembly 700 switches to the second working state, so that between the water inlet 701 and the drainage outlet 703 of the first valve chamber 711, and between the sewage inlet 704 and the sewage outlet 705 of the second valve chamber 712 are simultaneously communicated. The water container 100 drains to the outside of the washing machine, at the same time, the sewage outlet 6103 of the filtering device 600 is communicated to the sewage pipeline 240, so that the sewage in the filtering device 600 can be continuously discharged while draining, ensuring the discharge rate of sewage. On the other hand, the drainage of the water container 100 and the drainage of the filtering device 600 are performed at the same time, which improves the working efficiency of the washing machine and improves the user experience.

In this embodiment, the return water pipeline 230 is specifically connected to the window gasket 110 at the opening of the water container 100.

The sewage outlet 6103 of the filtering device 600 is connected to the connecting pipeline 280, the connecting pipeline 280 is connected to the sewage inlet 704 of the control valve assembly 700, and the water inlet end of the sewage pipeline 240 is connected to the sewage outlet 705 of the control valve assembly 700, forming a discharge channel of sewage in the filtering device 600.

Preferably, a return water control valve 231 is provided on the return water pipeline 230 for controlling the opening and closing of the return water pipeline 230. When the control valve assembly 700 is switched to the second working state, the return water control valve 231 is closed to cut off the return water pipeline 230 to ensure that the water in the filtering cavity 610 will not flow out from the filtered water outlet 6102, which is beneficial to discharging the filtered impurities residual in the filtering device 600 with the water flow.

Figure 3:
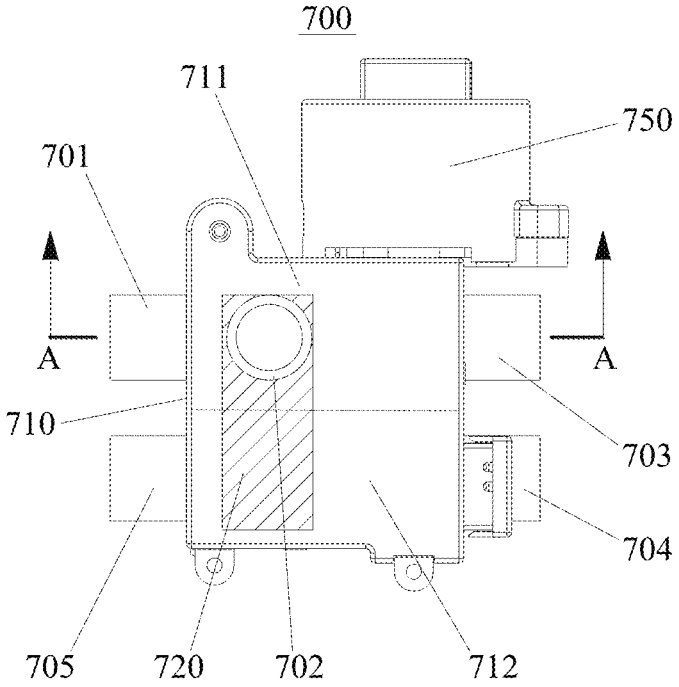
FIG. 3 is a schematic structural diagram of the control valve assembly in the embodiment of the present disclosure (the switching mechanism is in the second position)
Figure 4:
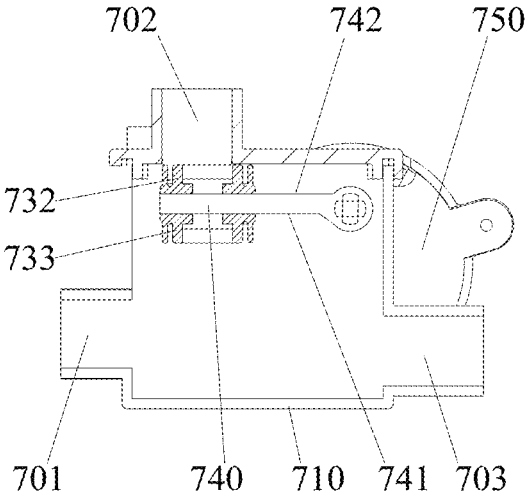
FIG. 4 is a schematic diagram of the AA section in FIG. 3 of the present disclosure.

The Control Valve Assembly 700 in this Embodiment is Shown in FIGS. 3 and 4, where the Switching Mechanism 720 Includes:

- a flap 740, which is rotatably installed inside the valve body 710 and has opposite a first surface 741 and a second surface 742;
- a drainage sealing component 733, which is provided on the first surface 741 of the flap 740 and is located inside the first valve chamber 711 for blocking the drainage outlet 703;
- a sewage sealing component is disposed on the first surface 741 of the flap 740 and located inside the second valve chamber 712 for blocking the sewage inlet 704;
- a circulation sealing component 732 is disposed on the second surface 742 of the flap 740 and is located inside the first valve chamber 711 for blocking the circulation water outlet 702.

The drainage outlet 703 and the sewage inlet 704 are provided on the same side surface of the valve body 710. When the switching mechanism 720 is in the first position, the drainage sealing component 733 and the sewage sealing component block the drainage outlet 703 and the sewage inlet 704 respectively; when the switching mechanism 720 is in the second position, the flap 740 moves away from the drainage outlet 703 and the sewage inlet 704 relative to the previous state until the circulation sealing component 732 blocks the circulation water outlet 702.

The flap 740 is connected to a driving motor 750 for driving the flap 740 to rotate in the valve body 710. The driving motor 750 is arranged outside the valve body 710, which avoids the risk of contact with water and is safer. The control valve assembly 700 drives the flap 740 to move through the driving motor 750, and can simultaneously control the opening/blocking switching of the circulating water outlet 702, the drainage outlet 703 and the sewage inlet 704, and has a simple structure. Compared with the existing solution in which a driven control valve is provided for each independent waterway, the cost is effectively saved.

In this embodiment, the first valve chamber 711 and the second valve chamber 712 of the control valve assembly 700 extend in a left and right direction and are arranged parallel to each other. The drainage outlet 703 is disposed on the right end cavity wall of the first valve chamber 711 in the length direction, and the sewage inlet 704 is disposed on the right end cavity wall of the second valve chamber 712.

Preferably, the water inlet 701 is provided on the left end wall of the first valve chamber 711, parallel to and opposite to the direction of the drainage outlet 703. The sewage outlet 705 is disposed on the left end wall of the second valve chamber 712, parallel to and opposite to the direction of the sewage inlet 704. When the control valve assembly 700 is in the second working state, the water flows from left to right in the first valve chamber 711 and from right to left in the second valve chamber 712, thus the resistance of the water flow is small. The washing machine drainage and the sewage discharge of the filtering device 600 is smoother.

The direction of the circulating water outlet 702 and the direction of the drainage outlet 703 are perpendicular to each other. The control valve assembly 700 switches from the first working state to the second working state. The flap 740 rotates 90° around its axis to move from the first position to the second position.

Specifically, in this embodiment, taking the orientation in FIG. 3 as an example, the first valve chamber 711 is disposed above the second valve chamber 712, and the circulating water outlet 702 is disposed on the front wall of the first valve chamber 711.

When the switching mechanism 720 is in the first position, the flap 740 is nearly parallel to the right end walls of the first valve chamber 711 and the second valve chamber 712, so that the drainage sealing component 733 blocks the drainage outlet 703, and the drainage sealing component blocks the sewage inlet. 704. When the switching mechanism 720 moves from the first position to the second position, the driving motor 750 drives the flap 740 to rotate forward 90°, causing the circulation sealing component 732 to block the circulation water outlet 702. At this time, the drainage sealing component 733 is separated from the drainage outlet 703, and the drainage outlet 703 is opened; the drainage sealing component is separated from the sewage inlet 704, and the sewage inlet 704 is opened.

In a further solution of this embodiment, before washing/rinsing water enters, the control valve assembly 700 is switched to the first working state, that is, the pump assembly 400 and the water inlet 6101 are connected and the sewage outlet 6103 and the sewage pipeline 240 are disconnected; starting to feed water into the water container 100, after the water level in the water container 100 is greater than the preset water level, the pump assembly 400 is turned on to perform a circulating filtration operation, and after the circulating filtration operation is completed, a sewage discharge operation is performed;

The circulating filtration operation and the sewage discharge operation are executed alternately until the washing/rinsing process is completed.

In the circulating filtration operation of this embodiment, the preset number of times described in step S4 is set to 3 times. That is, in one cycle of filtering operation, the washing machine turns on and off the pump assembly 400 three times, and when the pump assembly 400 is turned off for the third time, and after the driving mechanism 660 is turned on to drive the filtering mechanism 620 to continue to rotate in the filtering cavity 610 for the third preset time $T_3$, the control valve assembly 700 switches to the second working state to perform the sewage operation.

Figure 6:
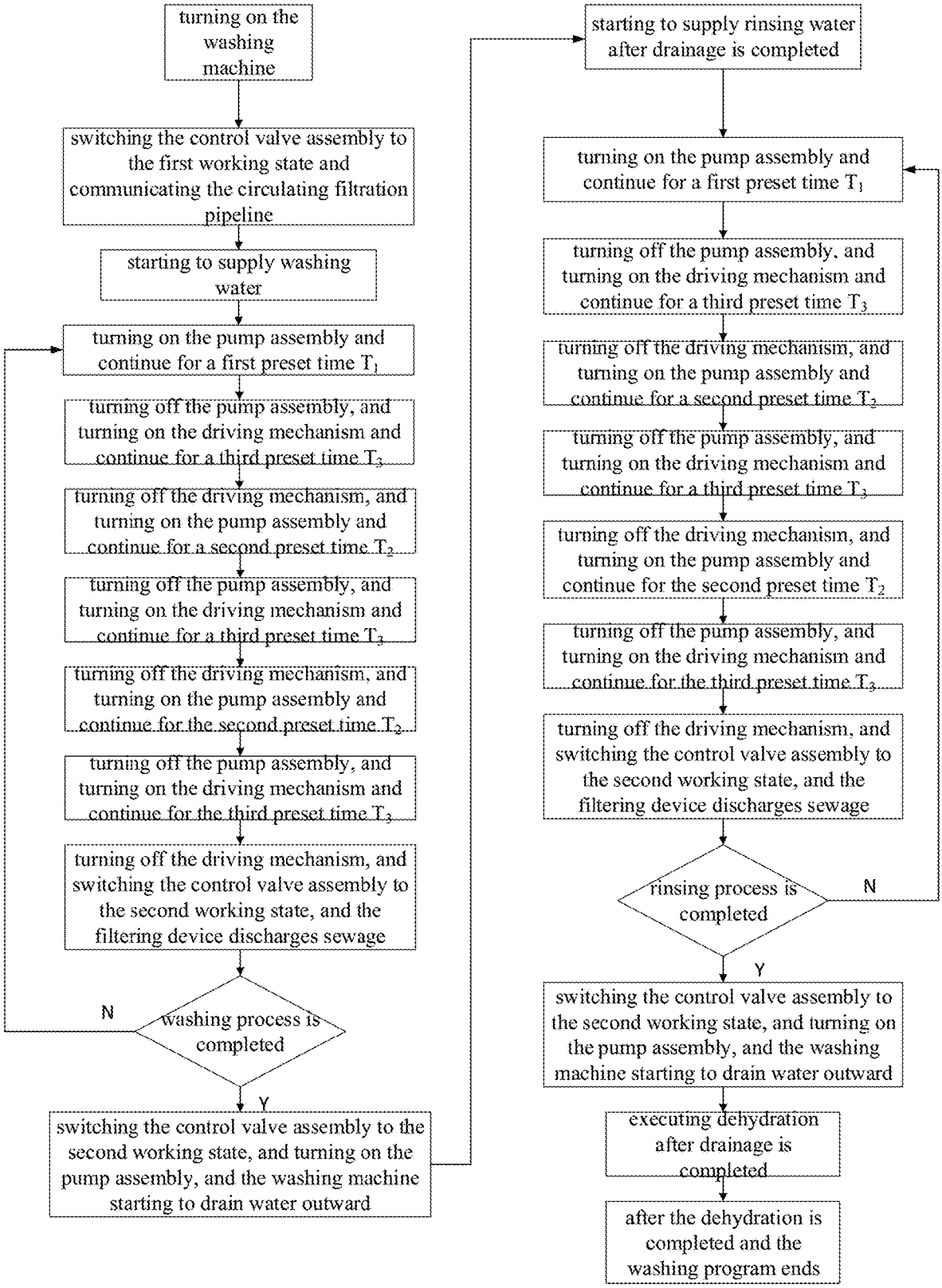
FIG. 6 is a flow chart of the control method in Embodiment 1 of the present disclosure.

FIG. 6 shows a flow chart of the washing machine in this embodiment running a complete washing program, which includes the following steps:

1) turning on the washing machine;
2) switching the control valve assembly to the first working state and communicating the circulating filtration pipeline;
3) starting to supply washing water;
4) turning on the pump assembly and continue for a first preset time $T_1$;
5) turning off the pump assembly, and turning on the driving mechanism and continue for a third preset time $T_3$;
6) turning off the driving mechanism, and turning on the pump assembly and continue for a second preset time $T_2$;
7) turning off the pump assembly, and turning on the driving mechanism and continue for a third preset time $T_3$;
8) turning off the driving mechanism, and turning on the pump assembly and continue for the second preset time $T_2$;
9) turning off the pump assembly, and turning on the driving mechanism and continue for the third preset time $T_3$;
10) turning off the driving mechanism, and switching the control valve assembly to the second working state, and the filtering device discharges sewage;
11) repeating step 4) to step 10) until the washing process is completed;
12) switching the control valve assembly to the second working state, and turning on the pump assembly, and the washing machine starting to drain water outward;
13) starting to supply rinsing water after drainage is completed;
14) repeating step 4) to step 10) until the rinsing process is completed;
15) switching the control valve assembly to the second working state, and turning on the pump assembly, and the washing machine starting to drain water outward;
16) executing dehydration after drainage is completed;
17) after the dehydration is completed and the washing program ends.

In this embodiment, the washing machine alternately performs circulating filtration operation and sewage discharge operation during the washing and rinsing processes, which can timely discharge the filtered impurities remaining inside the filtering device 600 through the sewage outlet 6103 to avoid accumulation of filtered impurities affecting the filtration efficiency. During the process of executing the circulating filtration operation, the pump assembly 400 is controlled to be turned on intermittently, and during the period when the pump assembly 400 is turned off, the filtering mechanism 620 is driven to rotate by driving the driving mechanism 660, so that filtered impurities such as lint and other lint attached to the filtering mechanism 620 are fully shed, and then the sewage is fully discharged during execution of the operation. Through the above process, the filtering device 600 can perform self-cleaning at any time during the running of the washing program, thereby avoiding the clogging of the filtering device 600 and ensuring the water filtration efficiency of the washing machine.

Through the structural design of the control valve assembly 700, a driving motor 750 can be used to control the water pumped out by the pump assembly 400 to be transported to the filtering device 600 or to the outflow pipeline 250, and at the same time control whether the sewage outlet 6103 of the filtering device 600 discharges sewage to the outside. The washing machine's circulating filtering operation, sewage discharge operation, and drainage operation are all controlled by the same control valve assembly 700. The internal water circulating structure of the washing machine is simplified, which saves more space and reduces costs.

Embodiment 2

Figure 5:
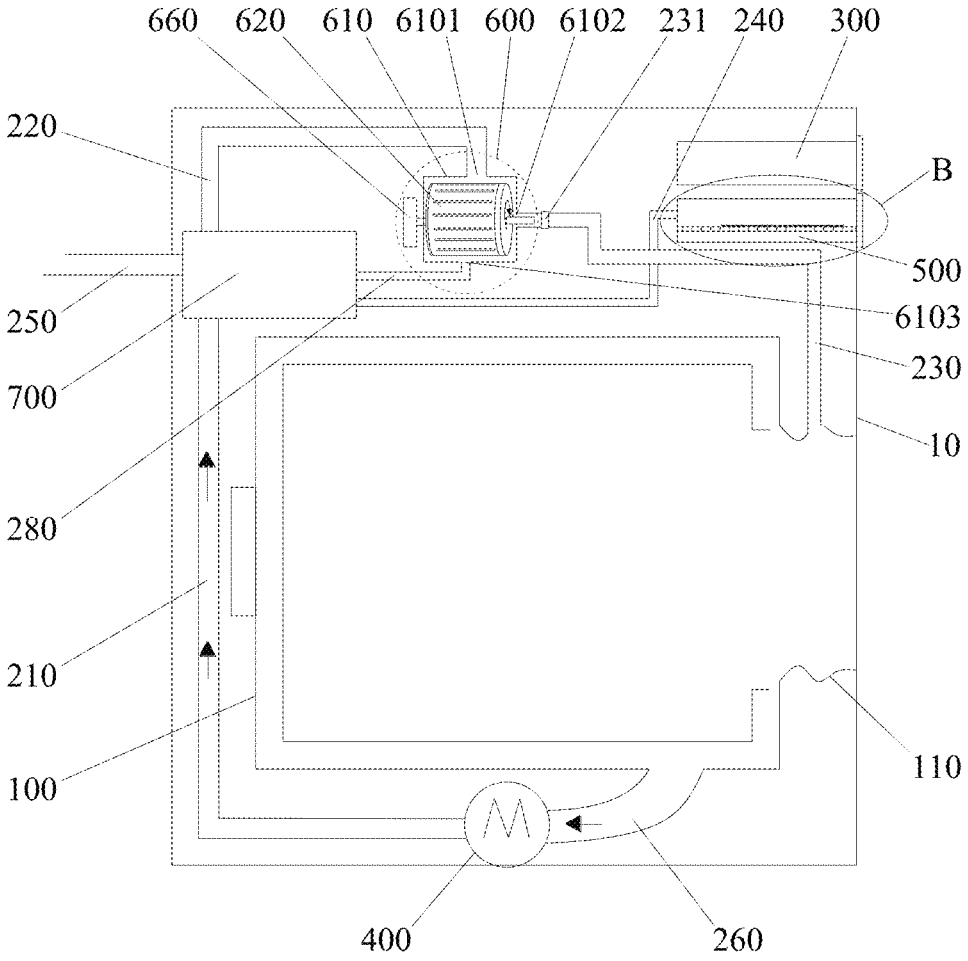
FIG. 5 is a schematic structural diagram of a washing machine in an embodiment of the present disclosure.
Figure 7:
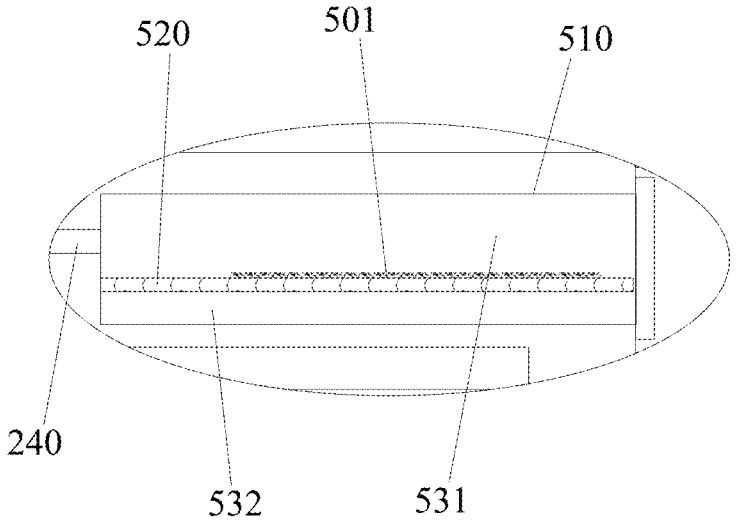
FIG. 7 is an enlarged schematic view of B in FIG. 5 of the present disclosure.

As shown in FIGS. 5 and 7, this embodiment is a further limitation of the above-mentioned Embodiment 1. The washing machine further includes a recovery device 500. The recovery device 500 is connected to the water outlet end of the sewage pipeline 240 and is used to collect sewage discharged from the filtering device 600.

Specifically, the recovery device 500 is used to collect filtered impurities 501 such as lint that are discharged with the sewage.

There may be fine lint in the filtered impurities 501. If the sewage carrying the filtered impurities 501 is directly poured into the drainage water of the washing machine and drained away with the washing machine, the fine lint will enter the ecological cycle, thereby causing harm to the ecological environment and human body.

The washing machine of this embodiment is equipped with a recovery device 500. After the sewage carrying filtered impurities 501 is discharged from the sewage outlet 6103, it can enter the recovery device 500 through the sewage pipeline 240 and be collected, without entering the drainage water flow and being discharged with the drainage water flow out of the washing machine.

In a Further Solution of this Embodiment, the Recovery Device 500 Includes:

a housing 510 with a recovery chamber inside;
a filter component 520, which is disposed in the recovery chamber and divides the recovery chamber into a first chamber 531 and a second chamber 532.

The sewage outlet 6103 of the filtering device 600 is connected to the first chamber 531. The sewage carrying the filtered impurities 501 enters the first chamber 531 and is filtered by the filter component 520 before entering the second chamber 532, and the filtered impurities 501 are collected in the first chamber 531.

In the above solution, the filter component 520 is provided in the recovery device 500 to filter the sewage discharged from the filtering device 600 and separate the filtered impurities 501 therein from the water. The interior of the recovery device 500 is divided into a first chamber 531 and a second chamber 532 by the filter component 520. The filtered impurities 501 in the sewage are blocked by the filter component 520, thereby collecting the filtered impurities 501 on the upper surface of the filter component 520 in the first chamber 531, the filtered clean water is collected in the second chamber 532. Users can directly collect and process the separated filtered impurities 501, avoiding the situation where the filtered impurities 501 are mixed in water and cannot be effectively processed.

Specifically, the filter component 520 can be a frame horizontally arranged at a certain height in the recovery chamber and a filter screen laid on the frame. After the sewage carrying filtered impurities 501 enters the first chamber 531, the water can enter the second chamber 532 through the filter component 520. The filtered impurities 501 are blocked by the filter screen and remain on the upper surface of the filter component 520.

In this embodiment, the washing machine further includes a box body 10 in which the water container 100 and the filtering device 600 are disposed. The recovery device 500 is installed on the box body 10 in an insertable/extractable manner, and the user can withdraw the recovery device 500 from the box body 10 for cleaning.

Specifically, the housing 510 of the recovery device 500 is disposed on the box body 10 so as to be insertable/extractable, and the upper side of the housing 510 has an opening. When the user pulls out the housing 510 from the box body 10, the filtered impurities 501 attached to the upper surface of the filter component 520 can be cleaned through the opening on the upper side of the housing 510. The filter component 520 is preferably detachably connected to the housing 510. The user can detach the filter component 520 from the inside of the housing 510 and take it out for cleaning, which makes the operation more convenient.

In a preferred solution of this embodiment, a water outlet is provided on the second chamber 532 for discharging filtered clean water. By arranging a water outlet in the second chamber 532, the clean water entering the second chamber 532 can be discharged from the recovery device 500 in a timely manner, thus preventing the recovery device 500 from overflowing when a large amount of sewage is discharged from the filtering device 600. Otherwise, the capacity of the second chamber 532 needs to be increased, that is, the volume of the recovery device 500 needs to be increased, causing it to occupy a larger space inside the washing machine, which is not conducive to miniaturization of the overall volume of the washing machine.

On the other hand, the water in the second chamber 532 can be automatically discharged from the water outlet. When the user cleans the recovery device 500, he only needs to clean the filtered impurities 501 on the filter component 520 without manually pouring out the clear water of the second chamber 532. When the filter component 520 is detachably installed in the housing 510, the user does not even need to completely remove the housing 510 from the washing machine box body 10, but only needs to take out the filter component 520 for cleaning, which is more convenient to operate.

In a preferred solution of this embodiment, the water outlet of the second chamber 532 is connected to the water container 100, and the water collected in the second chamber 532 is transported to the water container 100. For example, the water outlet of the second chamber 532 can be connected to the return water pipeline 230, or directly connected to the water container 100 through the pipeline. Alternatively, the water outlet of the second chamber 532 is connected to the detergent box 300 on each side of the recovery device 500. Since the detergent box 300 and the water container 100 are connected through pipelines, the water collected in the second chamber 532 can pass through the detergent box 300 enters the water container 100.

Since the sewage entering the recovery device 500 has been filtered by the filter component 520 in the recovery device 500, the filtered impurities 501 have been removed, and the clean water collected in the second chamber 532 does not contain the filtered impurities 501. By sending it into the water container 100, this part of clean water can be reused, thereby reducing the amount of water required when the washing machine continues to operate, and achieving the purpose of saving water consumption of the washing machine.

In another preferred solution of this embodiment, the water outlet of the second chamber 532 may directly or indirectly lead to the outside of the washing machine. For example, the water outlet of the second chamber 532 is connected to the outer discharge pipeline 250 through a pipeline, and the water collected in the second chamber 532 is discharged from the washing machine through the outer discharge pipeline 250.

Since the clean water collected in the second chamber 532 does not contain the filtered impurities 501, directly discharging it will not cause the problem of fine lint particles entering the ecological cycle.

In this embodiment, the recovery device 500 is provided inside the washing machine. The sewage containing filtered impurities 501 discharged by the filtering device 600 can be passed into the recovery device 500 after passing through the connecting pipeline 280, the control valve assembly 700 and the sewage pipe 240 in sequence. It is collected and discharged directly without flowing into the drain water of the washing machine. This prevents the fine lint debris in the filtered impurities 501 from entering the ecological cycle with the drainage water and affecting the ecological environment and human health. The filter component 520 is provided in the recovery device 500 to filter the collected sewage, thereby separating the filtered impurities 501 from water to facilitate the cleaning of the filtered impurities 501.

Embodiment 3

Figure 8:
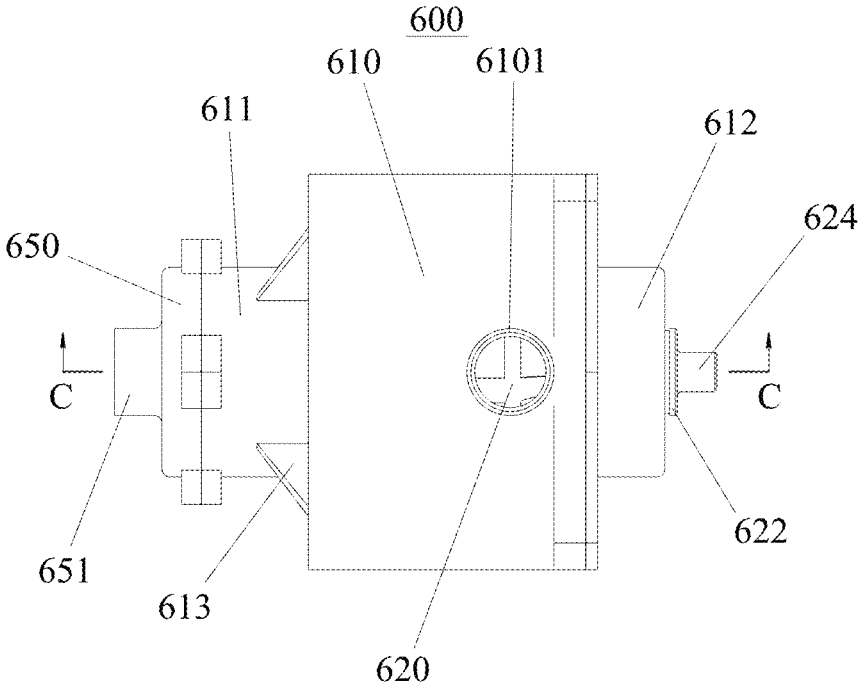
FIG. 8 is a schematic structural diagram of the filtering device in Embodiment 3 of the present disclosure.
Figure 9:
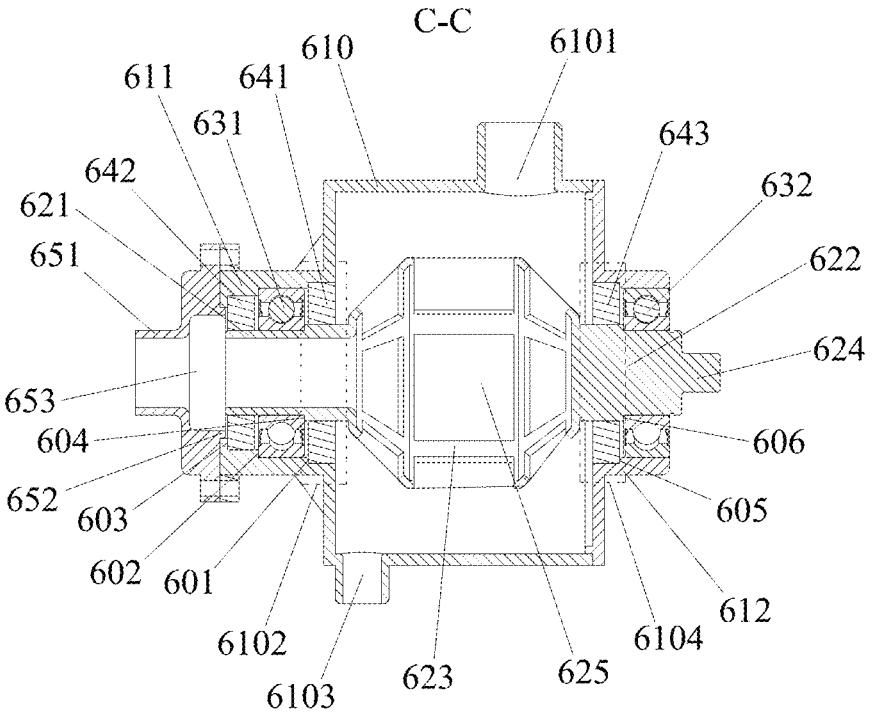
FIG. 9 is a schematic view of the CC section in FIG. 8 of the present disclosure.

As shown in FIGS. 8 and 9, this embodiment is a further limitation of the filtering device 600 in the embodiment 1 or 2. The outer circumference of the filtered water outlet 6102 of the filtering device 600 extends toward the outside of the filtering cavity 610 to form a sealing support part 611, one end of the filtering mechanism 620 has a water outlet joint 621 inserted in the sealing support part 611, and the water outlet joint 621 is rotatably and sealingly connected to the sealing support part 611. The first bearing 631 is sleeved on the water outlet joint 621. A first seal 641 is provided on the side of the first bearing 631 facing the inside of the filtering cavity 610 for blocking the gap between the water outlet joint 621 and the sealing support part 611.

Specifically, the filtering mechanism 620 includes a filter holder and a filter screen 625, wherein the filter holder includes:

- a filter support part 623, which is located inside the filtering cavity 610, and the filter screen 625 covers the surface of the filter support part 623;
- a water outlet joint 621, which is provided at the left end of the filter support part 623, and is rotatably inserted into the sealing support part 611;
- a rotating support part 622 is provided at the right end of the filter support part 623 and is rotatably connected to the filtering cavity 610.

In the above solution, a first bearing 631 is provided between the water outlet joint 621 and the sealing support part 611 to support the water outlet joint 621, so that the water outlet joint 621 rotates more smoothly in the sealing support part 611, and at the same time, the structure is stable, which can ensure filtration. The filtering mechanism 620 rotates stably in the filtering cavity 610. A first seal 641 is provided on the right side of the first bearing 631 so that the washing water in the filtering cavity 610 cannot enter the gap between the water outlet joint 621 and the sealing support part 611, thus preventing the first bearing 631 from contacting water and avoiding the failure of the first bearing 631 which ensures the effect of the first bearing 631. At the same time, the first seal 641 also prevents unfiltered wash water from flowing out from the filtered water outlet 6102 through the sealing support part 611 and affecting the efficiency of the filtering device 600 in removing lint.

In the specific solution of this embodiment, the first seal 641 is sleeved on the water outlet joint 621, the inner wall of the first seal 641 is sealingly connected to the outer wall of the water outlet joint 621, and the outer wall of the first seal 641 is rotatably connected to the inner wall of the sealing support part 611 in a sealed manner.

In a further solution of this embodiment, the filtering device 600 also includes a second seal 642. The second seal 642 is disposed on the side of the first bearing 631 facing away from the inside of the filtering cavity 610, blocking the gap between the water outlet joint 621 and the sealing support part 611.

Specifically, the second seal 642 is sleeved on the water outlet joint 621, the inner wall of the second seal 642 is sealingly connected to the outer wall of the water outlet joint 621, and the outer wall of the second seal 642 is rotatably connected with the inner wall of the sealing support part 611 in a sealed manner.

In the above solution, the water flowing out through the water outlet joint 621 can be blocked by the second seal 642 and will not contact the first bearing 631. The first bearing 631 is disposed between the first seal 641 and the second seal 642 to ensure that the installation environment of the first bearing 631 is water-free to the greatest extent, preventing the first bearing 631 from rusting when exposed to water and affecting the rotation of the filtering mechanism 620.

In a further solution of this embodiment, the inner wall of the sealing support part 611 has a stepped structure. From one end of the sealing support part 611 to the outside of the filtering cavity 610, a first limiting surface 601, a second limiting surface 602 and a third limiting surface 603 with an annular structure and gradually decreasing inner diameters are formed.

The surface of the first seal 641 facing the outside of the filtering cavity 610 is in contact with the first limiting surface 601. The surface of the first bearing 631 facing the outside of the filtering cavity 610 is in contact with the second limiting surface 602. The surface of the second seal 642 facing the outside of the filtering cavity 610 is in contact with the third limiting surface 603.

In the above solution, a plurality of vertical annular limiting surfaces are formed by the inner wall of the sealing support part 611 with a stepped structure, respectively abutting the left side surfaces of the first seal 641, the first bearing 631 and the second seal 642, which can limit the movement of the above three in the axial direction of the water outlet joint 621, and prevent the matching structure between the water outlet joint 621 and the sealing support part 611 from loosening during the rotation of the filtering mechanism 620.

In the preferred solution of this embodiment, the outer diameter of one end of the water outlet joint 621 close to the outside of the filtering cavity 610 is smaller than the outer diameter of the other end. A fourth limiting surface 604 with annular structure is formed on the outer wall of the water outlet joint 621 and is perpendicular to the axis of the water outlet joint 621. The surface of the first bearing 631 facing the inside of the filtering cavity 610 is in contact with the fourth limiting surface 604.

By arranging the outer diameter of the left end of the water outlet joint 621 to be smaller than the right end, the fourth limiting surface 604 toward the left is formed at the sudden change in the outer diameter, and is in contact with the right surface of the first bearing 631. In this way, both sides of the first bearing 631 have limiting structures, making the structure more stable.

In this embodiment, one end of the sealing support part 611 away from the filtering cavity 610, that is, the left end of the sealing support part 611 is connected to the filtering cavity flange 650. The filtering cavity flange 650 has a through port 653 in the middle that communicates with the water outlet joint 621. The outer periphery of the through port 653 extends away from the sealing support part 611 to form a connection part 651.

Preferably, the surface of the filtering cavity flange 650 facing the sealing support part 611 has a raised plug-in part 652, and the plug-in part 652 is inserted into the opening at the left end of the sealing support part 611.

In the above solution, the left end of the sealing support part 611 is connected to the filtering cavity flange 650, and a connection part 651 is formed on the filtering cavity flange 650. The outer diameter of the connection part 651 is smaller than the outer diameter of the sealing support part 611, and the inner diameter of the connection part 651 is preferably equal to the inner diameter of the water outlet joint 621. When the filtering device 600 is installed in the washing machine, it is connected to the return water pipeline through the connection part 651 on the filtering cavity flange 650. Compared with the way in which the return water pipeline is directly connected to the left end of the sealing support part 611, the installation is easier.

The right side of the filtering cavity flange 650 has an insertion part 652 inserted into the left end opening of the sealing support part 611 to facilitate positioning when the filtering cavity flange 650 and the sealing support part 611 are assembled. A number of fixing parts are respectively provided on the outer periphery of the filtering cavity flange 650 and the sealing support part 611, and screws are passed through the fixing parts to realize the fixation of the filtering cavity flange 650 and the sealing support part 611.

In a further solution of this embodiment, the rotating support part 622 at the right end of the filtering mechanism 620 extends along its rotation axis toward the outside of the filtering cavity 610. The filtering cavity 610 is provided with an installation opening 6104 for the rotating support part 622 to pass through. The rotating support part 622 is rotatably and sealingly connected to the installation opening 6104.

In this embodiment, the filtering mechanism 620 is driven to rotate by the driving mechanism. In order to prevent the driving mechanism from contacting the washing water, the driving mechanism is arranged outside the filtering cavity 610. To this end, the rotating support part 622 extends from the right end of the filtering cavity 610, and a motor mounting part 624 is provided at the right end of the rotating support part 622 for connection with a driving mechanism, such as a motor.

Further, the outer periphery of the installation opening 6104 extends along the axis of the rotating support part 622 to form a sleeve part 612 out of the filtering cavity 610. The third seal 643 is sleeved on the rotating support part 622. The inner wall of the third seal 643 is sealingly connected to the outer wall of the rotating support part 622, and the outer wall of the third seal 643 is rotatably sealingly connected to the inner wall of the sleeve part 612.

A second bearing 632 is also provided between the sleeve part 612 and the rotating support part 622. The second bearing 632 is sleeved on the rotating support part 622 and is located on the side of the third seal 643 facing the outside of the filtering cavity 610.

In the above solution, the arrangement of the third seal 643 prevents the water in the filtering cavity 610 from leaking from the installation opening 6104, and the arrangement of the second bearing 632 can support the rotating support part 622 to ensure that the relative rotation between the rotating support part 622 and the sleeve part 612 is smoother. The second bearing 632 is disposed on the right side of the third seal 643 and is not in contact with the water in the filtering cavity 610 to avoid failure.

In the preferred solution of this embodiment, the inner diameter of one end of the sleeve part 612 close to the outside of the filtering cavity 610 is smaller than the inner diameter of the other end. A fifth limiting surface 605 with annular structure is formed on the inner wall of the sleeve part 612 and is perpendicular to the axis of the rotating support part 622. The surface of the third seal 643 facing the outside of the filtering cavity 610 is in contact with the fifth limiting surface 605.

The outer diameter of one end of the rotating support part 622 close to the outside of the filtering cavity 610 is smaller than the outer diameter of the other end. A sixth limiting surface 606 with an annular structure and perpendicular to the axis of the rotating support part 622 is formed on the outer wall of the rotating support part 622. The surface of the second bearing 632 facing the inside of the filtering cavity 610 is in contact with the sixth limiting surface 606.

In the above solution, the inner diameter of the right end of the sleeve part 612 is smaller than the inner diameter of the left end, and the fifth limiting surface 605 toward the left is formed at a sudden change in the inner diameter to contact the right surface of the third seal 643. The outer diameter of the right end of the rotating support part 622 is smaller than the outer diameter of the left end, and a sudden change in the outer diameter forms a sixth limiting surface 606 toward the right, which contacts the left surface of the second bearing 632. The above structure limits the movement of the third seal 643 and the second bearing 632 in the axial direction of the rotating support part 622, and the structure is stable.

In this embodiment, the first seal 641, the second seal 642 and the third seal 643 are all oil seals, and the right wall of the filtering cavity 610 is provided separately from its peripheral side wall. First, the filtering mechanism 620, as well as the first seal 641, the second seal 642 and the first bearing 631 at its left end are integrally installed inside the filtering cavity 610, and the third seal 643 and the second bearing 632 are installed at its right end, and finally fasten the right wall of the filtering cavity 610 with its peripheral side wall.

In this embodiment, the cross-sectional area of the middle region of the filter support part 623 is constant, and its left and right ends have tapered structures, so that the partial surface of the filter screen 625 is tilted, which is beneficial to the shedding of attached lint.

In this embodiment, the orientation of the water inlet 6101 and the sewage outlet 6103 on the filtering cavity 610 is perpendicular to the axial direction of the filtering mechanism 620.

Preferably, the filtering cavity 610 has a cylindrical structure, the water inlet 6101 is located near the right end of the filtering cavity 610, the sewage outlet 6103 is located near the left end of the filtering cavity 610, and the water inlet 6101 and the sewage outlet 6103 are symmetrical in circumferential position of the filtering cavity 610.

In the above solution, the water inlet 6101 is positioned as far away from the water outlet joint 621 as possible so that the area of the filter screen 625 can be fully utilized. The water inlet 6101 and the sewage outlet 6103 are arranged up and down, and are staggered in the axial direction of the filtering cavity 610, which is conducive to fully discharging the sewage after cleaning the filtering device 600 in the filtering cavity 610.

In a further solution of this embodiment, the outer wall of the sealing support part 611 is provided with reinforcing ribs 613 extending in the radial direction of the sealing support part 611, and the reinforcing ribs 613 are connected to the surface of the filtering cavity 610 where the filtered water outlet 6102 is located.

Since the sealing support part 611 extends to a certain length from the left end surface of the filtering cavity 610, the reinforcing ribs 613 are provided to support its peripheral side wall from the outside, ensuring the strength of the sealing support part 611.

In the filtering device 600 of this embodiment, the first bearing 631 and the second bearing 632 are respectively provided at both ends of the filtering mechanism 620 for support, which ensures that the filtering mechanism 620 rotates smoothly and stably in the filtering cavity 610. At the same time, through the arrangement of the first seal 641, the second seal 642 and the third seal 643, the first bearing 631 and the second bearing 632 are prevented from being in contact with water, thereby avoiding failure.

The above are only preferred embodiments of the present disclosure, and do not limit the present disclosure in any form. Although the present disclosure has been disclosed above in preferred embodiments, it is not intended to limit the present disclosure. Anyone familiar with the technology of this patent without departing from the scope of the technical solution of the present disclosure, personnel can make some changes or modify the above-mentioned technical contents into equivalent embodiments with equivalent changes. In essence, any simple modifications, equivalent changes and modifications made to the above embodiments still fall within the scope of the present disclosure.

The invention claimed is:

1. A control method for a washing machine comprising:

during a washing process or a rinsing process, alternately performing:

a circulating filtration operation comprising:

operating a pump assembly in an open state to pump water from a water container through a circulating filtration pipeline to a first water inlet of a filtering device, controlling a control valve assembly to connect the pump assembly with the first water inlet and to disconnect a first sewage outlet from a sewage pipeline, and circulating water from the filtering device back to the water container through a filtered water outlet; and a sewage discharge operation comprising:

stopping the pump assembly in a closed state, controlling the control valve assembly to disconnect the pump assembly from the first water inlet and to connect the first sewage outlet to the sewage pipeline, and discharging sewage in the filtering device into the sewage pipeline via the first sewage outlet;

wherein, the washing machine comprises:

the water container;

the circulating filtration pipeline, with a water inlet end and a water outlet end of the circulating filtration pipeline being connected to the water container respectively, and the pump assembly being installed thereon;

the filtering device, being configured to install on the circulating filtration pipeline and to have the first water inlet, the filtered water outlet and the first sewage outlet;

the sewage pipeline, being configured to receive sewage discharged from the first sewage outlet; and the control valve assembly.

2. The control method for the washing machine according to claim 1, wherein, during the circulating filtration operation, the pump assembly is controlled to be turned on intermittently;

the circulating filtration operation includes the following steps:

S1. the control valve assembly connecting the pump assembly and the first water inlet and disconnecting the first sewage outlet and the sewage pipeline;

S2. turning on the pump assembly and continue for a certain period of time;

S3. turning off the pump assembly and continue for a certain period of time;

S4. if step S2 is performed a number of times in the circulating filtration operation reaches a preset number of times, end the circulating filtration operation; otherwise, returning to step S2.

3. The control method for the washing machine according to claim 2, wherein, during the circulating filtration operation, the pump assembly continues to operate for a first preset time period $T_1$ after being turned on for a first time, and the pump assembly continues to operate for a second preset time length $T_2$ after each subsequent turn on; the first preset time length Tis greater than the second preset time length $T_2$.

4. The control method for the washing machine according to claim 2, wherein the filtering device includes:

a filtering cavity, being configured to arrange the first water inlet, the filtered water outlet and the first sewage outlet;

a filtering mechanism, being rotatably installed in the filtering cavity;

a driving mechanism, being configured to drive the filtering mechanism to rotate in the filtering cavity;

Step S3 further includes: while the pump assembly is closed, turning on the driving mechanism to drive the filtering mechanism to rotate in the filtering cavity.

5. The control method for the washing machine according to claim 4, wherein in step S3, the filtering mechanism continues to rotate while the pump assembly is turned off, and each time the drive mechanism is turned on, the filtering mechanism continues to rotate for a same length of time.

6. The control method for the washing machine according to claim 1, wherein, the washing machine further includes a discharge pipeline for draining water to outside, and the control valve assembly connects the first sewage outlet and the sewage pipeline while connecting the pump assembly and the discharge pipeline;

after the washing or the rinsing process is completed, the control valve assembly connects the pump assembly and the discharge pipeline, turns on the pump assembly, and the water in the water container is discharged from the washing machine through the discharge pipeline.

7. The control method for the washing machine according to claim 1, wherein, before water supply for the washing or the rinsing process, the control valve assembly connects the pump assembly and the first water inlet and disconnects the first sewage outlet and the sewage pipeline;

starting to supply water into the water container, after a water level in the water container is greater than a preset water level, turning on the pump assembly to perform the circulating filtration operation, after the circulating filtration operation is completed, performing the sewage discharge operation;

the circulating filtration operation and the sewage discharge operation are executed alternately until the washing or the rinsing process is completed.

8. A washing machine, wherein, adopting the control method for the washing machine according to claim 1.

9. The washing machine according to claim 8, wherein, the control valve assembly comprising:

a valve body, being configured to arrange a first valve chamber and a second valve chamber that are independent of each other in the valve body, wherein, the first valve chamber is provided with a second water inlet connected to the pump assembly and a circulating water outlet connected to the first water inlet; the second valve chamber is provided with a sewage inlet communicated with the first sewage outlet and a second sewage outlet communicated with the sewage pipeline;

a switching mechanism, being movably arranged inside the valve body and being configured to have a first position for opening the circulating water outlet and blocking the sewage inlet, and a second position for blocking the circulating water outlet and opening the sewage inlet.

10. The washing machine according to claim 8, wherein, the filtering device comprising:

a filtering cavity, being configured to arrange with the first water inlet, the filtered water outlet and the first sewage outlet;

a filtering mechanism, being rotatably installed in the filtering cavity;

cleaning particles, being arranged in the filtering cavity and being configured to clean an inner wall of the filtering cavity and an outer wall of the filtering mechanism with friction and collision of water flow.

11. The control method for the washing machine according to claim 3, wherein the filtering device includes:

a filtering cavity, being configured to arrange the first water inlet, the filtered water outlet and the first sewage outlet;

a filtering mechanism, being rotatably installed in the filtering cavity;

a driving mechanism, being configured to drive the filtering mechanism to rotate in the filtering cavity;

Step S3 further includes: while the pump assembly is closed, turning on the driving mechanism to drive the filtering mechanism to rotate in the filtering cavity.

12. The control method for the washing machine according to claim 5, wherein, in step S2, the pump assembly continues to operate at least the second preset time length $T_2$ after being turned on, in step S3, the filtering mechanism continues to operate a third preset time length $T_3$, and the third preset time length $T_3$ is less than the second preset time length $T_2$.

13. The control method for the washing machine according to claim 2, wherein, the washing machine further includes a discharge pipeline for draining water to outside, and the control valve assembly connects the first sewage outlet and the sewage pipeline while connecting the pump assembly and the discharge pipeline;

after the washing or the rinsing process is completed, the control valve assembly connects the pump assembly and the discharge pipeline, turns on the pump assembly, and the water in the water container is discharged from the washing machine through the discharge pipeline.

14. The control method for the washing machine according to claim 3, wherein, the washing machine further includes a discharge pipeline for draining water to outside, and the control valve assembly connects the first sewage outlet and the sewage pipeline while connecting the pump assembly and the discharge pipeline;

after the washing or the rinsing process is completed, the control valve assembly connects the pump assembly and the discharge pipeline, turns on the pump assembly, and the water in the water container is discharged from the washing machine through the discharge pipeline.

15. The control method for the washing machine according to claim 2, wherein, before water supply for the washing or the rinsing process, the control valve assembly connects the pump assembly and the first water inlet and disconnects the first sewage outlet and the sewage pipeline;

starting to supply water into the water container, after a water level in the water container is greater than a preset water level, turning on the pump assembly to perform the circulating filtration operation, after the circulating filtration operation is completed, performing the sewage discharge operation;

the circulating filtration operation and the sewage discharge operation are executed alternately until the washing or the rinsing process is completed.

16. The control method for the washing machine according to claim 3, wherein, before water supply for the washing or the rinsing process, the control valve assembly connects the pump assembly and the first water inlet and disconnects the first sewage outlet and the sewage pipeline;

starting to supply water into the water container, after a water level in the water container is greater than a preset water level, turning on the pump assembly to perform the circulating filtration operation, after the circulating filtration operation is completed, performing the sewage discharge operation;

the circulating filtration operation and the sewage discharge operation are executed alternately until the washing or the rinsing process is completed.

17. The washing machine according to claim 9, wherein, the washing machine further includes a discharge pipeline for draining water to the outside, and the first valve chamber is further provided with a drainage outlet connected to the discharge pipeline;

when the switching mechanism is in the first position, the drainage outlet is blocked, and when the switching mechanism is in the second position, the drainage outlet is opened.

18. The washing machine according to claim 9, wherein, the filtering device comprising:

a filtering cavity, being configured to arrange with the first water inlet, the filtered water outlet and the first sewage outlet;

a filtering mechanism, being rotatably installed in the filtering cavity;

cleaning particles, being arranged in the filtering cavity and being configured to clean an inner wall of the filtering cavity and an outer wall of the filtering mechanism with friction and collision of water flow.

* * * * *